US010894336B2

(12) United States Patent
Kim et al.

(10) Patent No.: US 10,894,336 B2
(45) Date of Patent: Jan. 19, 2021

(54) SUBSTRATE CUTTING DEVICE

(71) Applicant: Samsung Display Co., Ltd., Yongin-si (KR)

(72) Inventors: Woong Kim, Seoul (KR); Kyungwon Kang, Cheonan-si (KR); Buemjoon Kim, Hwaseong-si (KR); Jihoon Kim, Cheonan-si (KR); Teadong Kim, Asan-si (KR); Sungho Noh, Cheonan-si (KR); Junho Sim, Cheonan-si (KR); Hyungbo Shim, Seoul (KR); Heesuk Lee, Cheonan-si (KR); Jaeku Han, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/280,972

(22) Filed: Feb. 20, 2019

(65) Prior Publication Data

US 2019/0255725 A1 Aug. 22, 2019

(30) Foreign Application Priority Data

Feb. 22, 2018 (KR) ..... 10-2018-0021132

(51) Int. Cl.

| | |
|---|---|
| ***B62D 7/18*** | (2006.01) |
| ***B26D 7/18*** | (2006.01) |
| ***B26D 7/01*** | (2006.01) |
| ***B26D 7/00*** | (2006.01) |
| ***B26D 7/27*** | (2006.01) |

(52) U.S. Cl.

CPC ..... *B26D 7/1863* (2013.01); *B26D 7/0006* (2013.01); *B26D 7/01* (2013.01); *B26D 7/27* (2013.01)

(58) Field of Classification Search

CPC ..... B26D 7/1863; B26D 7/0006; B26D 7/01; B26D 7/27

See application file for complete search history.

(56) References Cited

U.S. PATENT DOCUMENTS 4,444,078 A * 4/1984 Pearl ..... B25B 11/005 269/21
5,022,793 A * 6/1991 Hoshino ..... B23Q 11/0042 406/123
5,062,334 A * 11/1991 Killilea ..... B26D 7/018 210/496
5,536,342 A * 7/1996 Reis ..... H05K 9/0015 156/64

(Continued)

FOREIGN PATENT DOCUMENTS

JP 4682872 B2 5/2011
KR 10-1280001 B1 7/2013

(Continued)

*Primary Examiner* — Omar Flores Sanchez

(74) *Attorney, Agent, or Firm* — Lewis Roca Rothgerber Christie LLP

(57) ABSTRACT

A substrate cutting device includes: a base portion; a stage on the base portion; a partition member spaced from the stage; and an exhausting structure below the cell substrate and configured to exhaust a gaseous substance. The stage has a top surface configured to support a cell substrate and a connection surface perpendicular to the top surface, and the partition member faces the connection surface and is configured to support the cell substrate.

20 Claims, 15 Drawing Sheets

(56) References Cited

U.S. PATENT DOCUMENTS

| | | | | | |
|---|---|---|---|---|---|
| 5,782,152 | A * | 7/1998 | Reis | B25B 11/005 | 83/22 |
| 5,800,661 | A * | 9/1998 | Reis | B25B 11/005 | 156/285 |
| 5,870,937 | A * | 2/1999 | Reis | B25B 11/005 | 83/24 |
| 5,938,882 | A * | 8/1999 | Bryant | B26D 7/10 | 156/701 |
| 6,003,418 | A * | 12/1999 | Bezama | B26D 7/1854 | 83/100 |
| 6,058,556 | A * | 5/2000 | Jones | B08B 5/02 | 134/122 R |
| 6,276,246 | B1 * | 8/2001 | Bezama | B26D 7/1854 | 83/100 |
| 6,341,549 | B2 * | 1/2002 | Kim | B26D 7/1854 | 83/99 |
| 6,925,922 | B2 * | 8/2005 | Manabe | H01L 21/4842 | 225/97 |
| 7,601,388 | B2 * | 10/2009 | Puffer | B01D 65/00 | 427/115 |
| 8,288,681 | B2 | 10/2012 | Murase et al. | | |
| 2005/0236765 | A1 * | 10/2005 | Puffer | B01D 65/00 | 271/307 |
| 2012/0073417 | A1 * | 3/2012 | Ujiie | B26D 7/018 | 83/24 |
| 2018/0370058 | A1 * | 12/2018 | Fukada | B23K 26/10 | |

FOREIGN PATENT DOCUMENTS

| | | | |
|---|---|---|---|
| KR | 10-2017-0104046 | A | 9/2017 |
| KR | 10-2017-0113888 | A | 10/2017 |

* cited by examiner

SUBSTRATE CUTTING DEVICE

CROSS-REFERENCE TO RELATED APPLICATION

This patent application claims priority to and the benefit of Korean Patent Application No. 10-2018-0021132, filed on Feb. 22, 2018 in the Korean Intellectual Property Office, the entire content of which is hereby incorporated by reference.

BACKGROUND

Field

Aspects of embodiments of the present disclosure relate to a substrate cutting device.

Description of the Related Art

Generally, a display device includes an organic light emitting display (OLED) panel, a liquid crystal display (LCD) panel, an electrophoretic display (ED) panel, a surface-conduction electron-emitter display (SED) panel, a vacuum fluorescent display (VFD) panel, or the like.

The display device may be used in mobile devices (e.g., smart phones, tablet personal computers, laptop computers, digital cameras, camcorders, and mobile information terminals) or other electronic products (e.g., slim televisions, exhibition display devices, and billboards).

Recently, various studies have been conducted into manufacturing a display device having a reduced thickness. Further, due to its portability and applicability to various devices, a flexible display device has attracted attention as a next-generation display device.

A process of fabricating a display device may include a cutting process. In the cutting process, contamination material may be produced from a substrate (e.g., from cutting a substrate).

SUMMARY

Embodiments of the present disclosure provide a substrate cutting device configured to easily remove (or exhaust) contamination material produced during a substrate cutting process.

According to an embodiment of the present disclosure, a substrate cutting device includes: a base portion; a stage on the base portion; a partition member spaced from the stage; and an exhausting structure below the cell substrate and configured to exhaust a gaseous substance. The stage has a top surface configured to support a cell substrate and a connection surface perpendicular to the top surface, and the partition member faces the connection surface and is configured to support the cell substrate.

The exhausting structure may be in the connection surface and may be configured to produce an airflow flowing toward the partition member.

The exhausting structure may be between the stage and the partition member and may be configured to produce an airflow flowing toward the partition member.

The partition member may include a plurality of partition members spaced from each other.

The exhausting structure may be between adjacent ones of the partition members when viewed in a direction normal to the connection surface.

The exhausting structure may partially overlap two adjacent ones of the partition members when viewed in a direction normal to the connection surface.

The exhausting structure may overlap a plurality of the partition members when viewed in a direction normal to the connection surface.

The partition member may have a first surface configured to support the cell substrate, a second surface on the base portion and facing the first surface, and a side surface extending between the first surface and the second surface.

Each of the first and second surfaces may have a polygonal shape defined by at least three vertices and edges joining the vertices.

A first vertex of the first surface from among the at least three vertices of the first surface may overlap a second vertex of the second surface from among the at least three vertices of the second surface when viewed in a plan view, and the first and second vertices may face the connection surface.

At least a portion of the side surface facing the connection surface may have a curved shape.

The top surface of the stage may be substantially coplanar with the first surface of the partition member.

The partition member may have: a top surface configured to support an outer portion of the cell substrate; an inner surface connected to the top surface, facing the connection surface and, surrounding a periphery of the stage; an outer surface connected to the top surface and facing the inner surface; and a penetration opening penetrating the inner surface and the outer surface and configured for the gaseous substance to be exhausted to an outside of the partition member therethrough.

The substrate cutting device may further include an inclined pattern. The inclined pattern may be spaced from the stage with the partition member therebetween and may have an inclined surface with a height that increases with increasing distance from the stage. The gaseous substance may be exhausted to an outside along the inclined surface.

At least one of the partition member and the stage may have a suction opening through which a gaseous substance is to be inhaled, and the cell substrate may be secured to the at least one of the partition member and the stage in a vacuum suction manner by the suction opening.

The substrate cutting device may further include a cutting member. The cutting member may be configured to cut the cell substrate along a cutting line, and the cutting line may be between the stage and the partition member.

The exhausting structure may include a plurality of exhausting structures overlapping the cutting line when viewed in a plan view.

According to an embodiment of the present disclosure, a substrate cutting device includes: a base portion having a first region and a second region surrounding a periphery of the first region; a stage on the first region; a cutting member configured to cut the cell substrate along a cutting line; a partition member on the second region and spaced from the stage; and an exhausting structure in the first region and configured to exhaust a gaseous substance toward a region below the cell substrate and to produce an airflow flowing from the first region toward the second region. The stage has a top surface configured to support a cell substrate and a connection surface perpendicular to the top surface, and the partition member faces the connection surface and is configured to support the cell substrate.

The substrate cutting device may further include an inclined pattern. The inclined pattern may be spaced from the stage with the partition member therebetween and may have an inclined surface with a height that increases with increasing distance from the stage. The airflow may be produced to exhaust the gaseous substance in an outward direction along the inclined surface.

The exhausting structure may include a plurality of exhausting structures overlapping the cutting line when viewed in a plan view.

BRIEF DESCRIPTION OF THE DRAWINGS

Example embodiments will be more clearly understood from the following brief description, taken in conjunction with the accompanying drawings. The accompanying drawings represent non-limiting, example embodiments as described herein.

Figure 1A:
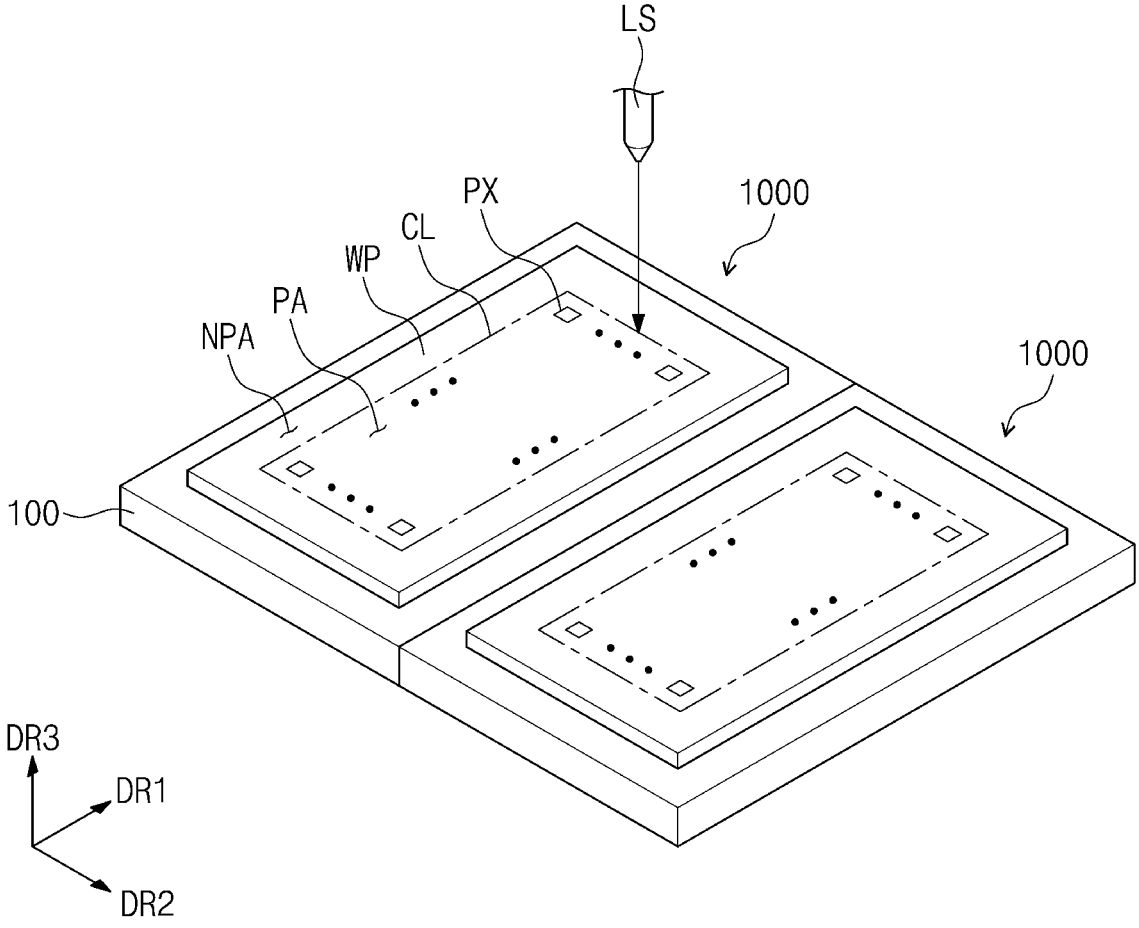
FIG. 1A is a schematic diagram illustrating a substrate cutting device according to an embodiment of the present disclosure.

It should be noted that these figures are intended to illustrate general characteristics of methods, structures, configurations, and/or materials utilized in certain example embodiments and are to supplement the written description provided below. These drawings are not, however, to scale and may not precisely reflect the structural or performance characteristics of any given embodiment and, accordingly, should not be interpreted as defining or limiting the range of values or properties encompassed by the present disclosure. For example, the relative thicknesses and positioning of layers, regions, and/or structural elements may be reduced or exaggerated in the figures for clarity. The use of similar or identical reference numbers in the various drawings is intended to indicate the presence of similar or identical elements or features.

DETAILED DESCRIPTION

Example embodiments of the present disclosure will now be described more fully with reference to the accompanying drawings, in which example embodiments are shown. Embodiments of the present disclosure may, however, be embodied in many different forms and should not be construed as being limited to the embodiments set forth herein; rather, these example embodiments are provided so that this disclosure will be thorough and complete and will fully convey the concept of the present disclosure to those of ordinary skill in the art.

It will be understood that when an element is referred to as being "connected" or "coupled" to another element, it can be directly connected or coupled to the other element or intervening elements may be present. When an element is referred to as being "directly connected" or "directly coupled" to another element, there are no intervening elements present. Other words used to describe the relationship between elements or layers should be interpreted in a like fashion (e.g., "between" versus "directly between," "adjacent" versus "directly adjacent," "on" versus "directly on"). As used herein the term "and/or" includes any and all combinations of one or more of the associated listed items. Further, the use of "may" when describing embodiments of the present disclosure relates to "one or more embodiments of the present disclosure." Expressions, such as "at least one of," when preceding a list of elements, modify the entire list of elements and do not modify the individual elements of the list.

It will be understood that, although the terms "first", "second", etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein should be interpreted accordingly.

The terminology used herein is for the purpose of describing particular embodiments only and is not intended to be limiting of the example embodiments. As used herein, the singular forms "a" and "an" are intended to include the plural forms as well, unless the context clearly indicates otherwise. It will be further understood that the terms "having," "comprises," "comprising, "includes," and/or "including," as used herein, specify the presence of stated features, integers, steps, operations, elements, and/or components but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments of the present disclosure belong. It will be further understood that terms, such as those defined in commonly-used dictionaries, should be interpreted as having a meaning that is consistent with their meaning in the context of the relevant art and should not be interpreted in an idealized or overly formal sense unless expressly so defined herein.

The control unit (or controller) and/or any other relevant devices or components according to embodiments of the present disclosure described herein may be implemented utilizing any suitable hardware, firmware (e.g., an application-specific integrated circuit), software, and/or a suitable combination of software, firmware, and hardware. For example, the various components of the control unit may be formed on one integrated circuit (IC) chip or on separate IC chips. Further, the various components of the control unit may be implemented on a flexible printed circuit film, a tape carrier package (TCP), a printed circuit board (PCB), or formed on a same substrate as the control unit. Further, the various components of the control unit may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device or the functionality of a particular computing device may be distributed across one or more other computing devices without departing from the scope of the exemplary embodiments of the present disclosure.

Figure 1B:
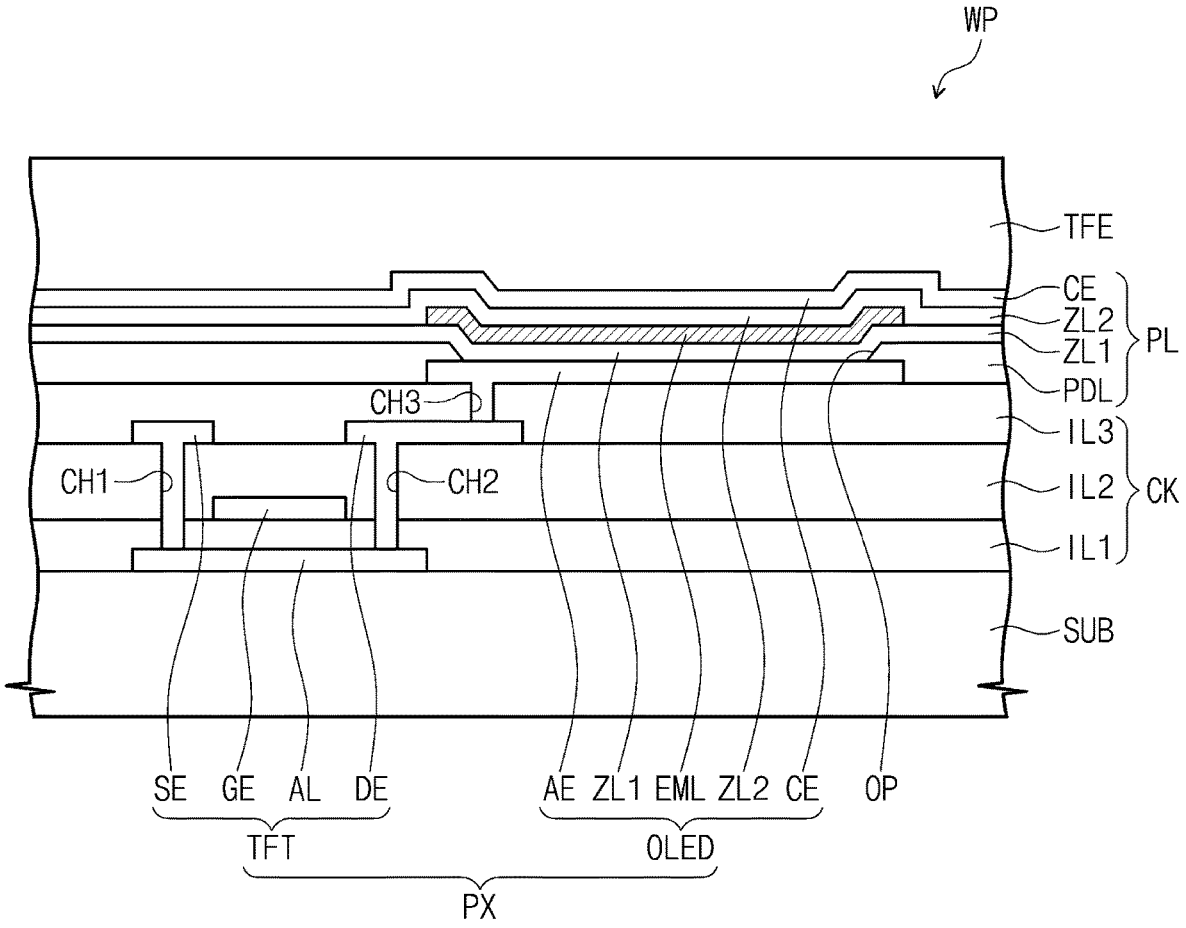
FIG. 1B is a sectional view illustrating a pixel according to an embodiment of the present disclosure.
Figure 2A:
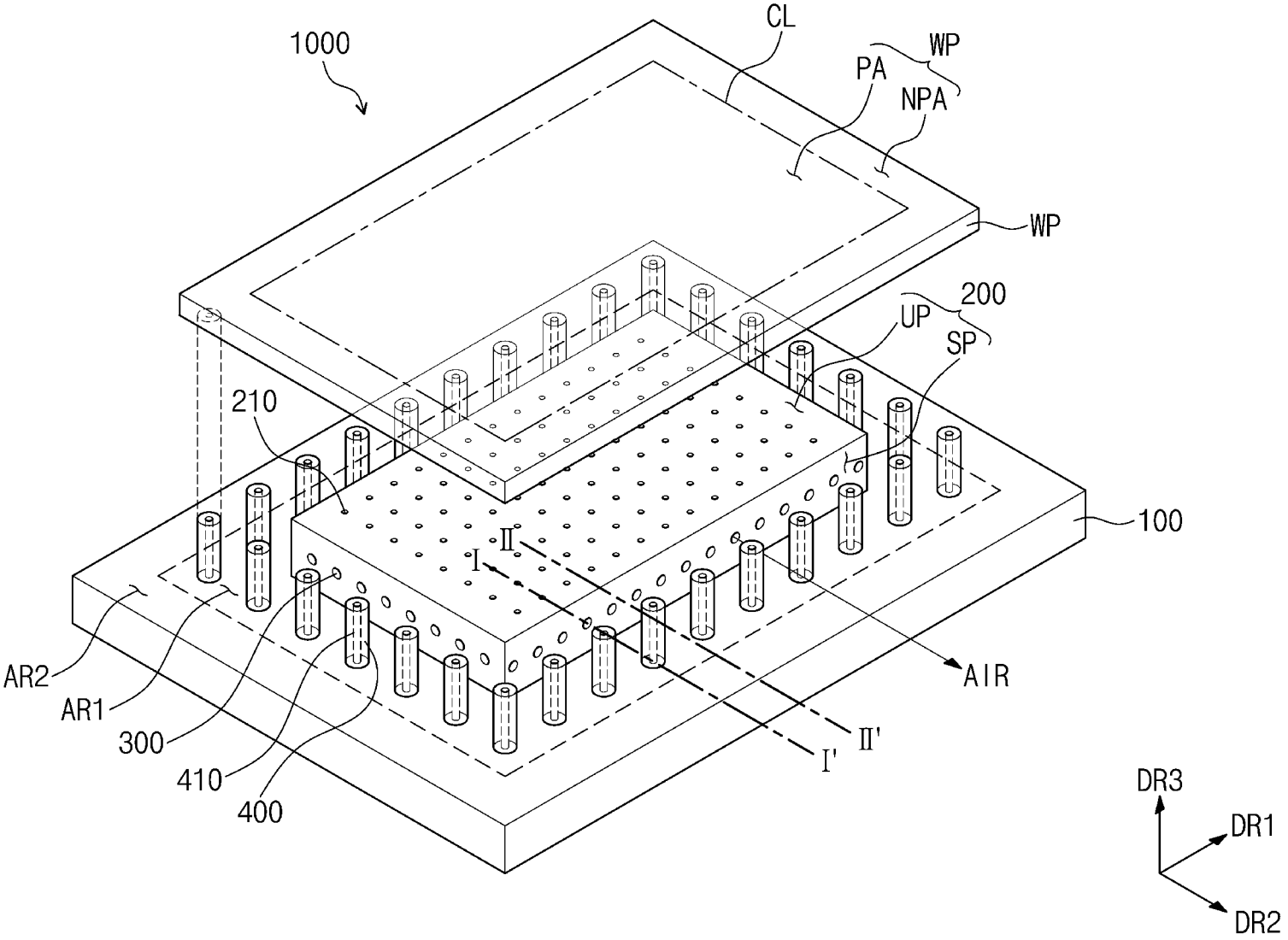
FIG. 2A is a perspective view illustrating a substrate cutting device according to an embodiment of the present disclosure.
Figure 2B:
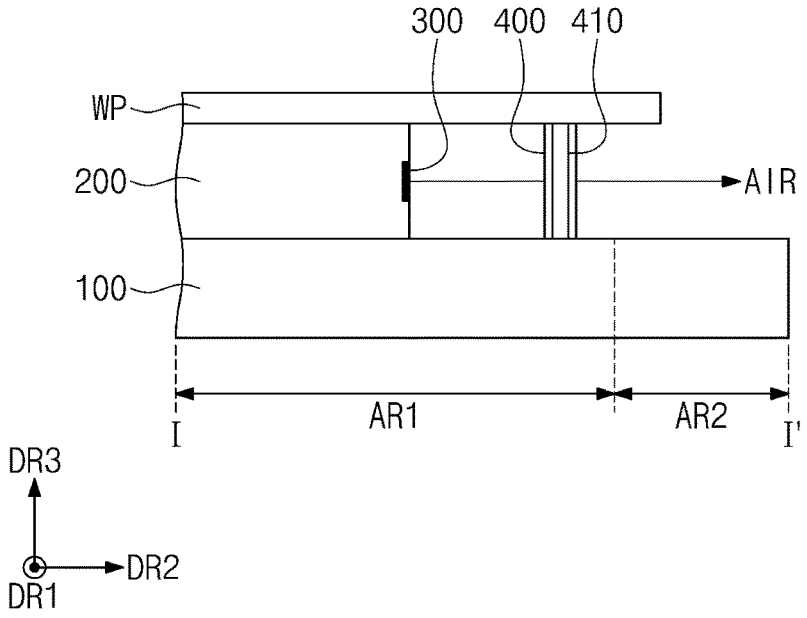
FIG. 2B is a sectional view taken along the line I-I' of FIG. 2A.
Figure 2C:
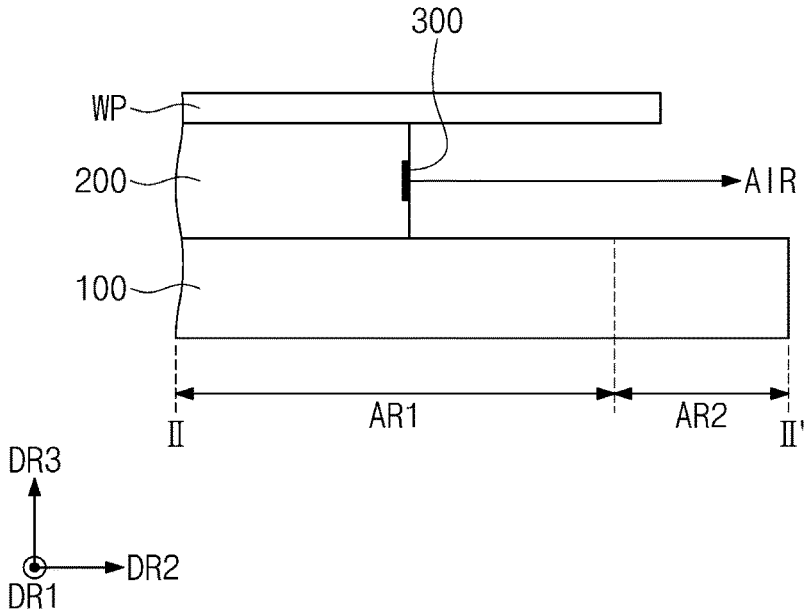
FIG. 2C is a sectional view taken along the line II-II' of FIG. 2A.

FIG. 1A is a schematic diagram illustrating a substrate cutting device according to an embodiment of the present disclosure. FIG. 1B is a sectional view illustrating a cell substrate according to an embodiment of the present disclosure. FIG. 2A is a perspective view illustrating a substrate cutting device according to an embodiment of the present disclosure, FIG. 2B is a sectional view taken along the line I-I' of FIG. 2A, and FIG. 2C is a sectional view taken along the line II-II' of FIG. 2A. Hereinafter, a substrate cutting device according to an embodiment of the present disclosure will be described with reference to FIGS. 1A-2C.

A plurality of substrate cutting devices 1000 may be provided (e.g., in a manufacturing setting). For convenience, the description that follows will refer to one substrate cutting device 1000.

The substrate cutting device 1000 may be used to cut a cell substrate WP along a cutting line CL by using a cutting member (e.g., a cutting device) LS. The cutting member LS may include a beam generator, which is configured to emit a laser beam, and an optical system, which is placed along a propagation path of the laser beam. The beam generator may be configured to generate a solid-state laser (e.g., a ruby laser, a glass laser, a yttrium aluminum garnet (YAG) laser, or a yttrium lithium fluoride (YLF) laser), a gas laser (e.g., an excimer laser or a helium-neon (He—Ne) laser), or a pulsed laser.

The optical system may be located along a propagation path of the laser beam generated by the beam generator. The optical system may include a homogenizer, which is configured to homogenize a beam shape of the laser beam, or a condensing lens, which is configured to adjust a focal length of the laser beam. Furthermore, the optical system may include a mirror, which is placed along the propagation path of the laser beam and is used to change a propagation angle of the laser beam. The mirror may include a Galvano mirror, which is configured to linearly change the propagation angle of the laser beam when an input voltage is changed, or a reflection mirror. In some embodiments, the cutting member LS may further include a control unit (e.g., a controller), which controls a position of the cutting member LS to allow the laser beam to be irradiated onto the cell substrate WP along the cutting line CL. The control unit may control size and intensity of the laser beam emitted from the beam generator based on an intensity or size value previously or newly input by an operator.

In some embodiments, a display module may be formed by cutting the cell substrate WP by using the cutting member LS, which is configured to be movable in a first direction DR1 and a second direction DR2. In an embodiment in which a plurality of the substrate cutting devices 1000 is provided, a plurality of display modules may be formed (e.g., may be formed concurrently).

The cell substrate WP may include a plurality of pixels PX. The cell substrate WP may include a panel region PA and a dummy region NPA, which are defined by (e.g., separated by) the cutting line CL. The panel region PA may be a region of the cell substrate WP that will be used as a part of a display or electronic device after a process of cutting the cell substrate WP along the cutting line CL. The pixels PX may be provided on the panel region PA, and the cutting line CL may be spaced apart from the pixels PX.

The panel region PA of the cell substrate WP, which remains after the dummy region NPA of the cell substrate WP is removed, may be used as a display module. For example, a shape of the display module may be defined by the cutting line CL when viewed in a plan view.

Referring to FIG. 1B, the pixel PX may include a base layer SUB, a circuit layer CK, and a display device layer PL.

The base layer SUB may include (or may be) a rigid substrate and/or a flexible substrate. For example, the base layer SUB may include (or may be) a glass substrate, a metallic substrate, and/or a plastic substrate.

The circuit layer CK may be provided on the base layer SUB. The circuit layer CK may include a thin-film transistor TFT and insulating layers IL1, IL2, and IL3.

A semiconductor pattern AL of the thin-film transistor TFT and the first insulating layer IL1 may be provided on the base layer SUB. The first insulating layer IL1 may be provided to cover the semiconductor pattern AL.

A control electrode GE of the thin-film transistor TFT and the second insulating layer IL2 may be provided on the first insulating layer IL1. The second insulating layer IL2 may be provided to cover the control electrode GE. Each of the first and second insulating layers IL1 and IL2 may include an organic layer and/or an inorganic layer. In some embodiments, each of the first and second insulating layers IL1 and IL2 may include a plurality of thin films.

An input electrode SE and an output electrode DE of the thin-film transistor TFT and the third insulating layer IL3 may be provided on the second insulating layer IL2. The third insulating layer IL3 may be provided to cover the input electrode SE and the output electrode DE.

The input electrode SE and the output electrode DE may be connected to the semiconductor pattern AL via a first through opening (e.g., a first through hole) CH1 and a second through opening (e.g., a second through hole) CH2, each of which is formed to penetrate the first insulating layer IL1 and the second insulating layer IL2.

An organic light emitting device OLED and a pixel definition layer PDL may be provided on the third insulating layer IL3. The pixel definition layer PDL may be formed on a region of the third insulating layer IL3 that overlaps the organic light emitting device OLED.

The display device layer PL may include the pixel definition layer PDL and the organic light emitting device OLED.

The organic light emitting device OLED may include an anode electrode AE, an emission pattern EML, a cathode electrode CE, a hole transport region ZL1 between the anode electrode AE and the emission pattern EML, and an electron transport region ZL2 between the cathode electrode CE and the emission pattern EML.

The anode electrode AE may be connected to the output electrode DE via a third through opening (e.g., third through hole) CH3, which is formed in the third insulating layer IL3.

The pixel definition layer PDL may be provided on the third insulating layer IL3. An opening OP may be defined in the pixel definition layer PDL to expose at least a portion of the anode electrode AE. The opening OP may be formed at a region corresponding a light-emitting region, which is where light is emitted from the organic light emitting device OLED.

The hole transport region ZL1 may be provided on the anode electrode AE to cover the anode electrode AE and the pixel definition layer PDL. The hole transport region ZL1 may include a hole injection layer, a hole transport layer, and/or a single layer having both a hole injection function and a hole transport function.

The emission pattern EML may be provided on the hole transport region ZL1. The emission pattern EML may be formed of or may include fluorescent and/or phosphorescent materials. The emission pattern EML may be configured to generate mono-chromatic light or multi-chromatic light.

The electron transport region ZL2 may be provided on the emission pattern EML to cover the emission pattern EML and the hole transport region ZL1. The electron transport region ZL2 may be formed of or may include an electron transport material and/or an electron injection material. The electron transport region ZL2 may be an electron transport layer including an electron transport material or a single electron injection/transport layer including both an electron transport material and an electron injection material.

The cathode electrode CE may be provided on the electron transport region ZL2 to face (e.g., opposite) the anode electrode AE. The cathode electrode CE may be formed of (or may include) a material having a low work-function and, hence, may provide for easier injection of electrons.

Materials of the cathode electrode CE and the anode electrode AE may be suitably varied depending on the light-emitting method of the panel region PA. For example, in an embodiment in which the panel region PA is a top-emission type, the cathode electrode CE may be a transparent electrode and the anode electrode AE may be a reflective electrode. In an embodiment in which the panel region PA is a bottom-emission type, the cathode electrode CE may be a reflective electrode and the anode electrode AE may be a transparent electrode. The present disclosure is not limited to a specific structure of the organic light emitting device in the panel region PA, and the structure of the organic light emitting device may be suitably varied.

A thin-film encapsulation layer TFE may be provided on the cathode electrode CE. The thin-film encapsulation layer TFE may be provided to fully cover the cathode electrode CE and, thereby, hermetically seal the organic light emitting device OLED. The thin-film encapsulation layer TFE may be formed by a deposition method. The thin-film encapsulation layer TFE may not substantially increase a thickness of the panel region PA.

The thin-film encapsulation layer TFE may include a plurality of inorganic layers. Each of the inorganic layers may be formed of or may include silicon nitride and/or silicon oxide. In some embodiments, the thin-film encapsulation layer TFE may further include a functional layer (i.e., one or more functional layers) interposed between the inorganic layers.

In FIG. 2A, in order to provide better understanding of the present disclosure, the substrate cutting device 1000 is illustrated as being spaced apart from the cell substrate WP. The substrate cutting device 1000 may include a base portion 100, a stage 200, an exhausting structure 300, and a partition member 400. The base portion 100 may have a first region AR1 and a second region AR2. In some embodiments, when viewed in a plan view, the first region AR1 may be a central region of the base portion 100 and the second region AR2 may be a region enclosing (e.g., around or surrounding a periphery of) the first region AR1.

The stage 200 may be provided on the first region AR1. The cell substrate WP may be provided on (e.g., received by) the stage 200. The stage 200 may have a top surface UP and a connection surface (e.g., a side surface) SP. The top surface UP may support the cell substrate WP. The top surface UP may overlap the panel region PA of the cell substrate WP when viewed in a plan view.

The connection surface SP may be a surface that is perpendicular to the top surface UP and is provided along an edge of the top surface UP. A length of the connection surface SP measured in a third direction DR3 may be defined as a height of the stage 200.

In some embodiments, the substrate cutting device 1000 may have a first suction opening (e.g., a first suction hole) 210. The first suction opening 210 may be provided in the top surface UP of the stage 200. A gaseous substance (e.g., external air) may be inhaled through the first suction opening 210 to secure (or fasten or adhere) the cell substrate WP onto the stage 200 in a vacuum suction manner. In some embodiments, a plurality of first suction openings 210 may be provided. In such embodiments, it may be possible to more stably secure the cell substrate WP to the stage 200 during a cutting process. For example, it may be possible to prevent or substantially reduce instances of the cutting member LS becoming misaligned with the cutting line CL due to, for example, vibration, which may occur during the cutting process. In some embodiments, a gaseous substance may be exhausted through the first suction opening 210 to the outside to allow the cell substrate WP to be easily separated from the stage 200 after the cutting process.

In some embodiments, the exhausting structure 300 may be provided on the connection surface SP of the stage 200. In some embodiments, a plurality of exhausting structures 300 may be provided and spaced apart from each other along the connection surface SP. The exhausting structure 300 may be configured to exhaust a gaseous substance AIR in a direction from the connection surface SP toward the outside of the base portion 100. For example, the exhausting structure 300 may be configured to direct airflow in a direction from the first region AR1 toward the second region AR2.

The exhausting structure 300 may be a circular opening (or hole) when viewed in a direction normal to the connection surface SP. However, the present disclosure is not limited thereto, and the shape of the exhausting structure 300 may be suitably varied as long as the exhausting structure 300 can be used to exhaust the gaseous substance AIR to the outside. In the stage 200, the exhausting structure 300 may be connected to a gaseous substance exhausting device (e.g., a pump) and may be used to exhaust a gaseous substance to the outside.

The partition member 400 may be provided on the first region AR1. When viewed in a plan view, the partition member 400 may be spaced apart from the stage 200 and may be nearer to the second region AR2 than to the stage 200. The partition member 400 may be provided around, but spaced apart from, the stage 200. The partition member 400 may be provided to support at least a portion of the cell substrate WP. The partition member 400 may overlap the dummy region NPA of the cell substrate WP when viewed in a plan view. For example, a portion of the panel region PA of the cell substrate WP may be supported by the stage 200, and a portion of the dummy region NPA of the cell substrate WP may be supported by the partition member 400. In an embodiment, the stage 200 and the partition member 400 may be provided to have substantially the same height in the third direction DR3.

As shown in FIG. 2A, the partition member 400 may have a circular shape. However, the shape of the partition member 400 may be suitably varied as will be described with reference to FIGS. 4A and 4B.

In FIG. 2A, a shape of one of the partition members 400, which overlaps the cell substrate WP, is depicted by a dotted line. As shown in FIGS. 2A and 2B, the substrate cutting device 1000 may further include a second suction opening (e.g., second suction hole) 410. The second suction opening 410 may be provided in (e.g., may extend through) the partition member 400. A gaseous substance may be inhaled though the second suction opening 410 in a direction opposite to the third direction DR3. The second suction opening 410 may penetrate (e.g., may extend entirely through) the partition member 400. In some embodiments, a plurality of second suction openings 410 may be provided. The second suction opening 410 may be configured to inhale a gaseous substance (e.g., external air) to secure the cell substrate WP onto the partition member 400 in a vacuum suction manner. Because a portion of the cell substrate WP located outside of the stage 200, such as the dummy region NPA, is located on and supported in a suction manner by the partition member 400, the cutting member LS may not become misaligned with the cutting line CL due to, for example, vibration, which may occur during the cutting process. In some embodiments, a gaseous substance may be exhausted through the second suction opening 410 in the third direction DR3 to allow the dummy region NPA to be easily separated from the partition member 400 after the cutting process.

In some embodiments, the exhausting structure 300 may overlap at least a portion of the partition member 400 when viewed in a direction normal to the connection surface SP. For example, as shown in FIGS. 2A and 2B, the exhausting structure 300 may overlap the partition member 400 when viewed in a vertical section defined by the first and third directions DR1 and DR3. In such embodiments, the gaseous substance AIR to be exhausted through the exhausting structure 300 may be exhausted to the outside in the second direction DR2 while passing through a space between the partition members 400.

In the embodiment shown in FIGS. 2A-2C, the exhausting structure 300 may not overlap the partition member 400 when viewed in a vertical section defined by the first and third directions DR1 and DR3. In such embodiments, the gaseous substance AIR may be exhausted to the outside (e.g., to the outside of the substrate cutting device 1000) with increased anisotropy in the second direction DR2. Thus, a foreign substance, which may be produced during a process of cutting the cell substrate WP, may be more easily exhausted to the outside of the stage 200 along with the gaseous substance AIR. As a result, an interval between cleaning steps of the substrate cutting device 1000 may be increased (e.g., it may be possible to reduce the cleaning frequency of the substrate cutting device 1000) and, thereby, improving process efficiency. Furthermore, because the airflow is exhausted in an outward direction, it may be possible to reduce an amount of contamination material flowing onto the cell substrate WP and, thereby, improving reliability of the produced display module.

Figure 3A:
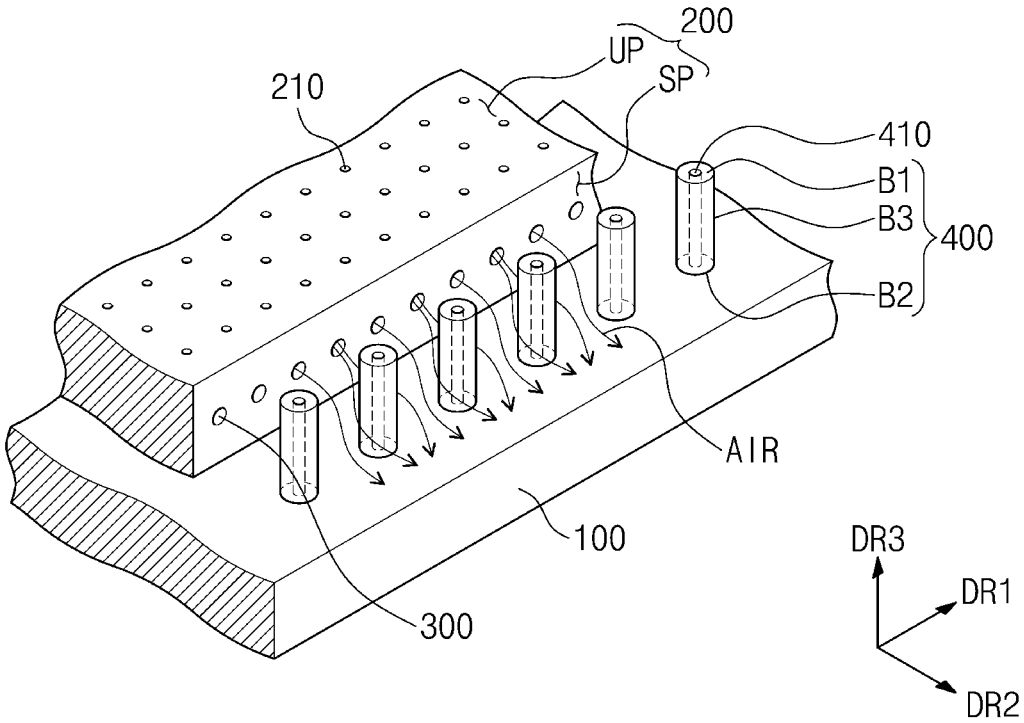
FIGS. 3A-3C are enlarged views, each of which illustrates a portion of a substrate cutting device according to embodiments of the present disclosure.
Figure 3B:
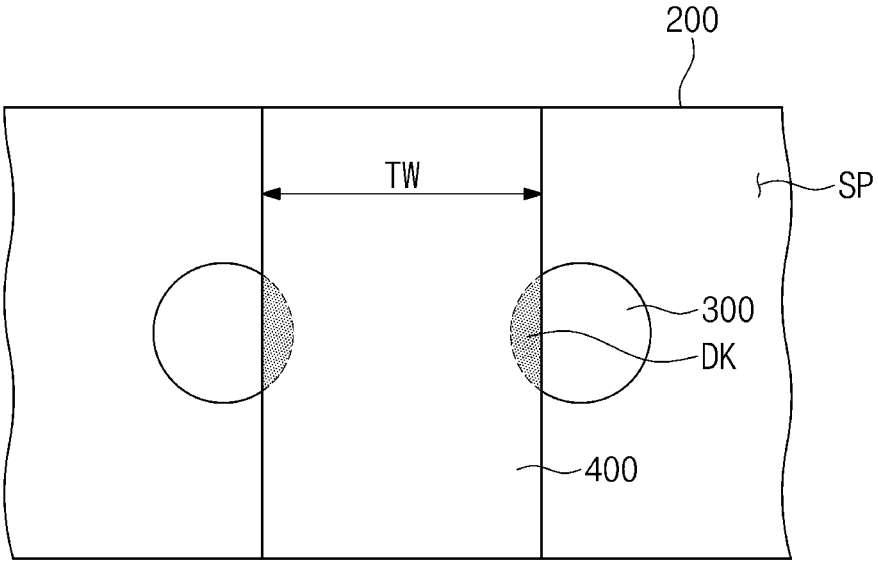
Figure 3C:
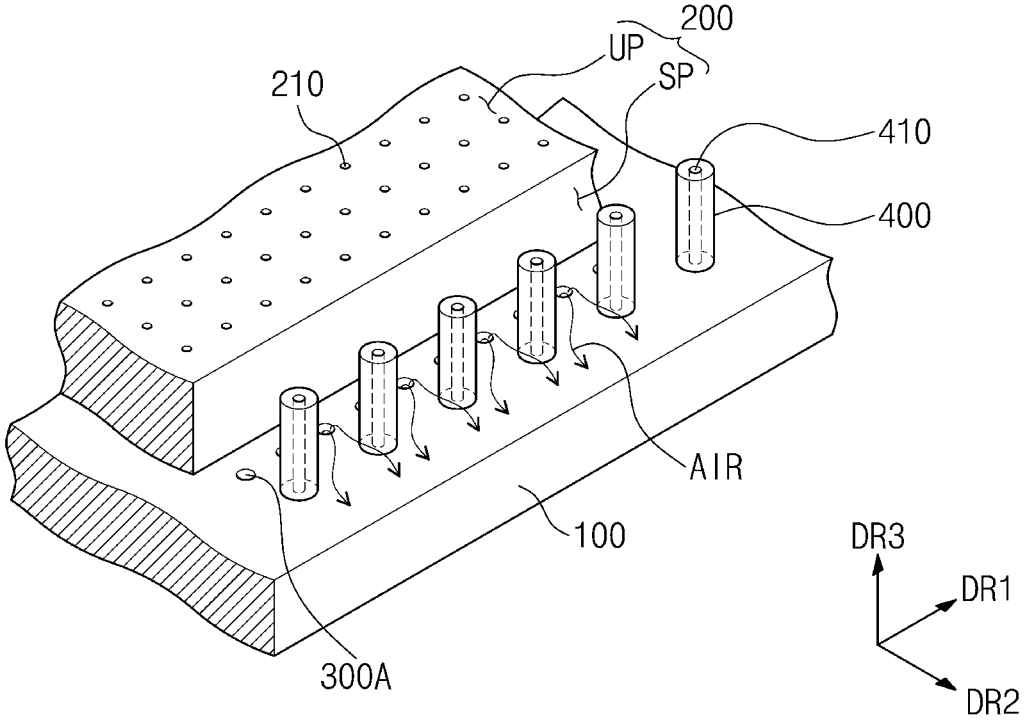

FIGS. 3A-3C are enlarged views, each of which illustrates a portion of a substrate cutting device according to embodiments of the present disclosure. For concise description, elements previously described with reference to FIGS. 1A-2C may be identified by the same reference number, and an overlapping description thereof may be omitted.

FIGS. 3A and 3B are diagrams illustrating a relative position of the partition member 400 with respect to the exhausting structure 300, which is provided in the connection surface SP of the stage 200.

The partition member 400 may have a top surface B1, a bottom surface B2, and a side surface B3. The top surface B1 may be a surface on which the cell substrate WP is directly provided. The bottom surface B2 may be opposite to the top surface B1 and may contact (e.g., may be placed on) the base portion 100. The side surface B3 may be perpendicular to both the top surface B1 and the bottom surface B2 and/or parallel to the third direction DR3 of FIG. 3A and may join (or extend between) the top surface B1 and the bottom surface B2.

The top surface B1 of the partition member 400 may be substantially coplanar with the top surface UP of the stage 200. For example, a height of the stage 200 measured in the third direction DR3 from the base portion 100 may be substantially equal to a height of the partition member 400 measured in the third direction DR3 from the base portion 100. Thus, the cell substrate WP may be horizontally provided in the substrate cutting device 1000 (e.g., the cell substrate WP may be horizontally provided on both the partition member 400 and the stage 200).

Referring to FIG. 3B, each of the partition members 400 may partially overlap respective adjacent ones of the exhausting structures 300. Such overlapping regions are depicted by shaded regions DK in FIG. 3B. A gaseous substance AIR to be exhausted through the exhausting structures 300 may form an airflow, which passes through a space TW between the partition members 400 while sweeping the overlapping regions (e.g., the shading regions DK) of the partition members 400. In some embodiments, because the airflow is directed to pass through the space TW between the partition members 400, an amount of a foreign substance accumulated in the space TW during the cutting process may be reduced and, thereby, reliability of the produced display module may be improved.

Referring to FIG. 3C, according to another embodiment, the exhausting structure 300A may be provided in the base portion 100. The exhausting structure 300A may be configured to exhaust the gaseous substance AIR from the base portion 100 in the third direction DR3, and in this embodiment, the cell substrate WP on the stage 200 may change a direction of an airflow of the gaseous substance AIR exhausted through the exhausting structure 300A to the second direction DR2 (e.g., from the third direction DR3 to the second direction DR2). Accordingly, even when a foreign substance is produced in a space below the cell substrate WP, the foreign substance, along with the airflow, may be easily exhausted to the outside of the substrate cutting device 1000.

Figure 4A:
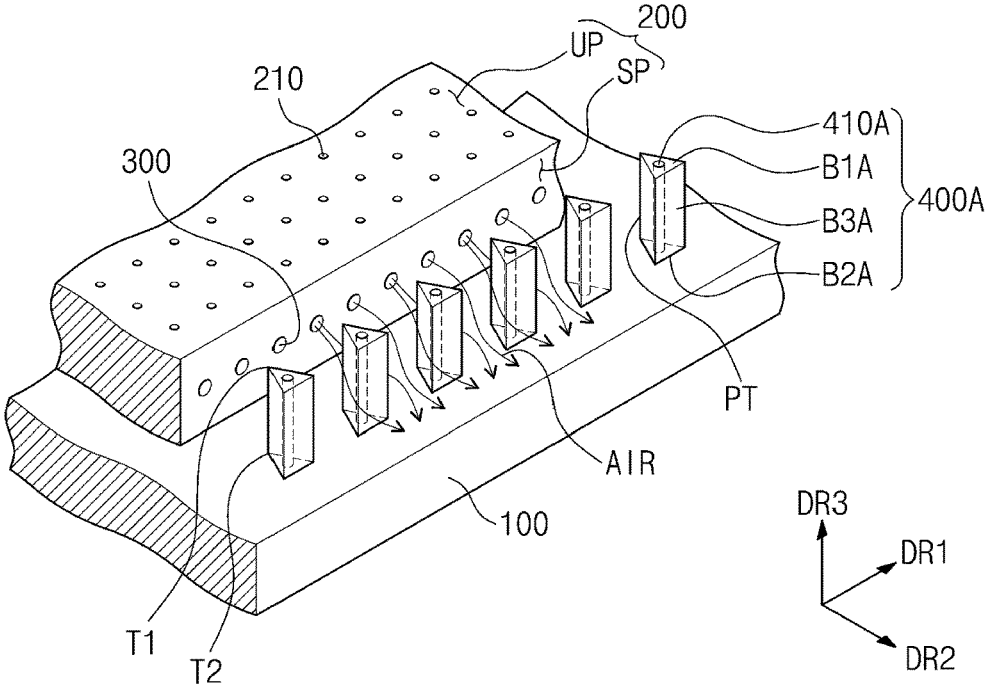
FIGS. 4A and 4B are perspective views illustrating example shapes of a partition member according to some embodiments of the present disclosure.
Figure 4B:
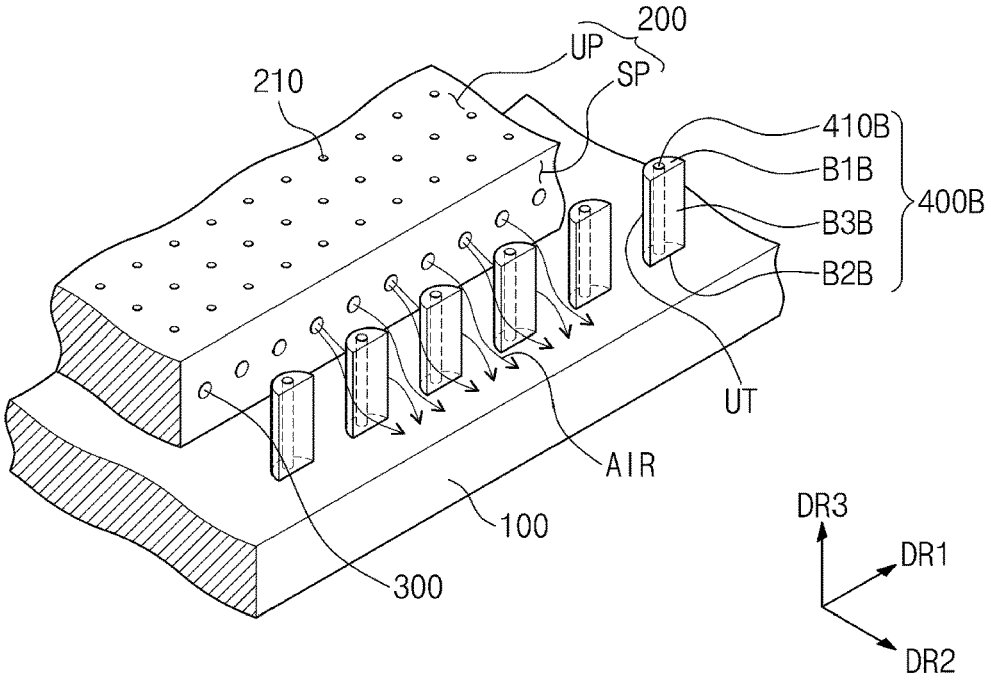

FIGS. 4A and 4B are perspective views illustrating example shapes of a partition member according to some embodiments of the present disclosure. For concise description, elements previously described with reference to FIGS. 1A-2C may be identified by the same reference number, and overlapping descriptions thereof may be omitted.

As shown in FIG. 4A, the stage 200 and the partition member 400A, shaped like a triangular pillar, may be provided on the base portion 100. The partition member 400 may have a top surface B1A, a bottom surface B2A, and a side surface B3A. The side surface B3A may be perpendicular to the top surface B1A and the bottom surface B2A and/or parallel to the third direction DR3 and may be provided to join (or extend between) the top surface B1A and the bottom surface B2A.

Each of the top and bottom surfaces B1A and B2A may have a polygonal shape defined by at least three vertices and edges joining the vertices. In FIG. 4A, each of the top and bottom surfaces B1A and B2A is illustrated as having a triangular shape. The top surface B1A, the bottom surface B2A, and the side surface B3A may be connected to form a triangular pillar structure. In some embodiments, a plurality of the partition members 400A spaced apart from each other may be provided on the base portion 100. However, the present disclosure is not limited to this example, and the shape and the number of the partition members may be variously changed as long as the partition members have a polygonal shape.

As shown in FIG. 4A, a first vertex T1 of the top surface B1A and a second vertex T2 of the bottom surface B2A, which overlap each other in a plan view, may be provided to face the connection surface SP. Accordingly, a surface area of the partition member 400A that is normal to an airflow direction of the gaseous substance AIR to be exhausted through the exhausting structure 300 may be reduced, and thus, the airflow of the gaseous substance AIR may be more stable in the second direction DR2.

In another embodiment, as shown in FIG. 4B, the partition member 400B may be provided to have an edge facing the connection surface SP. Such an edge of the partition member 400B may have a curved shape. For example, the partition member 400B may be provided in the form of a semi-circular pillar, as shown in FIG. 4B. The side surface B3B may include a facing surface UT facing the connection surface SP and having a curved shape. In this embodiment, a portion (e.g., the facing surface UT) of the side surface B3B may have the curved shape, and each of the top surface BIB and the bottom surface B2B may have a semi-circular shape. Accordingly, the partition member 400B may be provided in the form of a semi-circular pillar. In some embodiments, a plurality of the partition members 400B may be provided on the base portion 100, and in such embodiments, at least one of the partition members 400B may have the semi-circular pillar shape.

As described above, the partition member according to embodiments of the present disclosure may be pillar-shaped (e.g., a circular pillar shown in FIG. 2A, a semi-circular pillar shown in FIG. 4B, and a polygonal or triangular pillar shown in FIG. 4A). Owing to the pillar-shaped structure of the partition member, the gaseous substance AIR, which is emitted from the connection surface SP through the exhausting structure 300, may be more easily exhausted to the outside. For example, when the gaseous substance AIR is exhausted from the connection surface SP toward the partition member 400A and contacts the partition member 400A having the vertices T1 and T2, disturbances of the gaseous substance AIR passing by or around the partition member 400A may be reduced compared to an embodiment in which the partition member has a simple flat facing surface, and such features may make it possible to more easily exhaust the gaseous substance AIR to the outside. Furthermore, when, as shown in FIG. 4B, the partition member 400B has the facing surface UT, disturbance of the gaseous substance AIR to be exhausted to the outside through the partition member may be reduced when compared to an embodiment in which the partition member has a simple flat facing surface. Accordingly, an airflow of the gaseous substance AIR may be easily exhausted to the outside without standstill between the connection surface SP and the partition member 400A or 400B, and hence, it may be possible to prevent or reduce depositing or accumulation of a foreign substance, which may be produced during the cutting process, on the base portion 100.

Figure 5A:
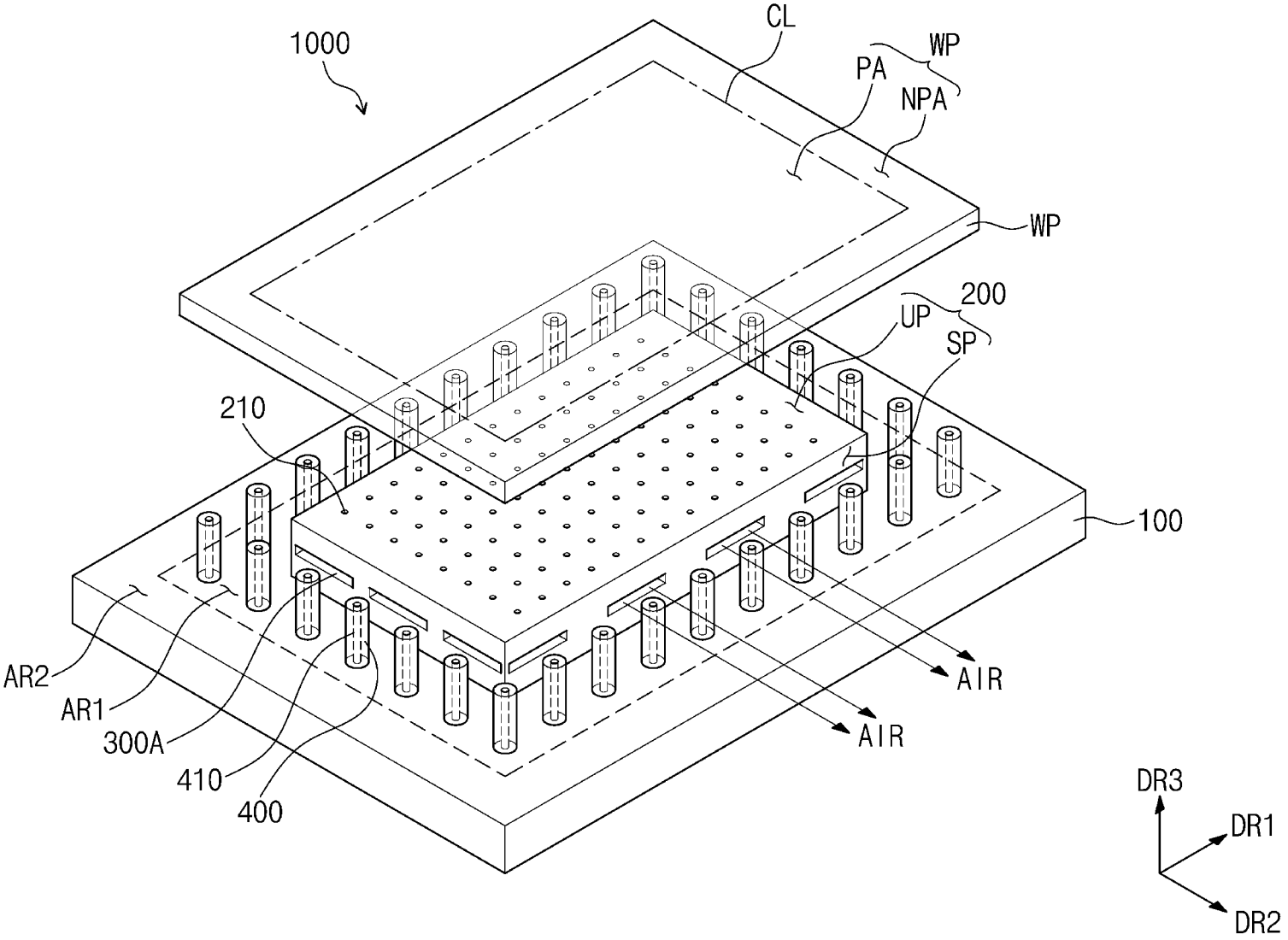
FIG. 5A is a perspective view illustrating a substrate cutting device according to an embodiment of the present disclosure.
Figure 5B:
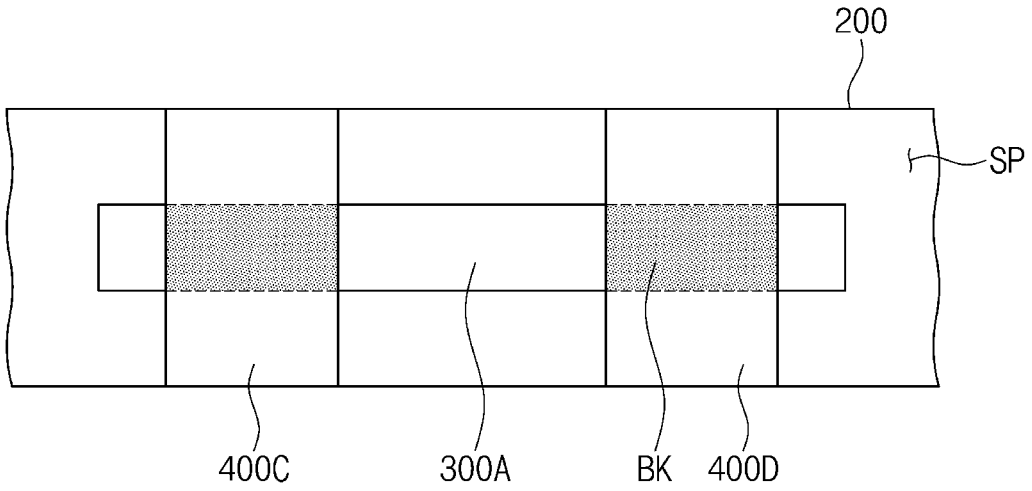
FIG. 5B is an enlarged view illustrating a portion of the substrate cutting device shown in FIG. 5A.

FIG. 5A is a perspective view illustrating a substrate cutting device according to an embodiment of the present disclosure, and FIG. 5B is an enlarged view illustrating a portion of the substrate cutting device shown in FIG. 5A. For concise description, elements previously described with reference to FIGS. 1A-2C may be identified by the same reference number, and overlapping descriptions thereof may be omitted.

Referring to FIGS. 5A and 5B, the exhausting structure 300A provided in the connection surface SP may have a rectangular shape. The exhausting structure 300A may overlap a plurality of partition members 400C and 400D from among the partition members 400 when viewed in a direction normal to the connection surface SP. An airflow of a gaseous substance AIR to be exhausted through the exhausting structure 300 may be disturbed by overlapping regions BK of the partition members 400C and 400D that overlap the exhausting structure 300A.

This disturbance may result in the airflow of the gaseous substance AIR passing through spaces between the partition members 400C and 400D and between the partition members 400C and 400D and the stage 200. Accordingly, it may be possible to prevent or reduce deposition or accumulation of a foreign substance, which may be produced during the cutting process, on the base portion 100 or between the partition members 400C and 400D and the connection surface SP.

Figure 6A:
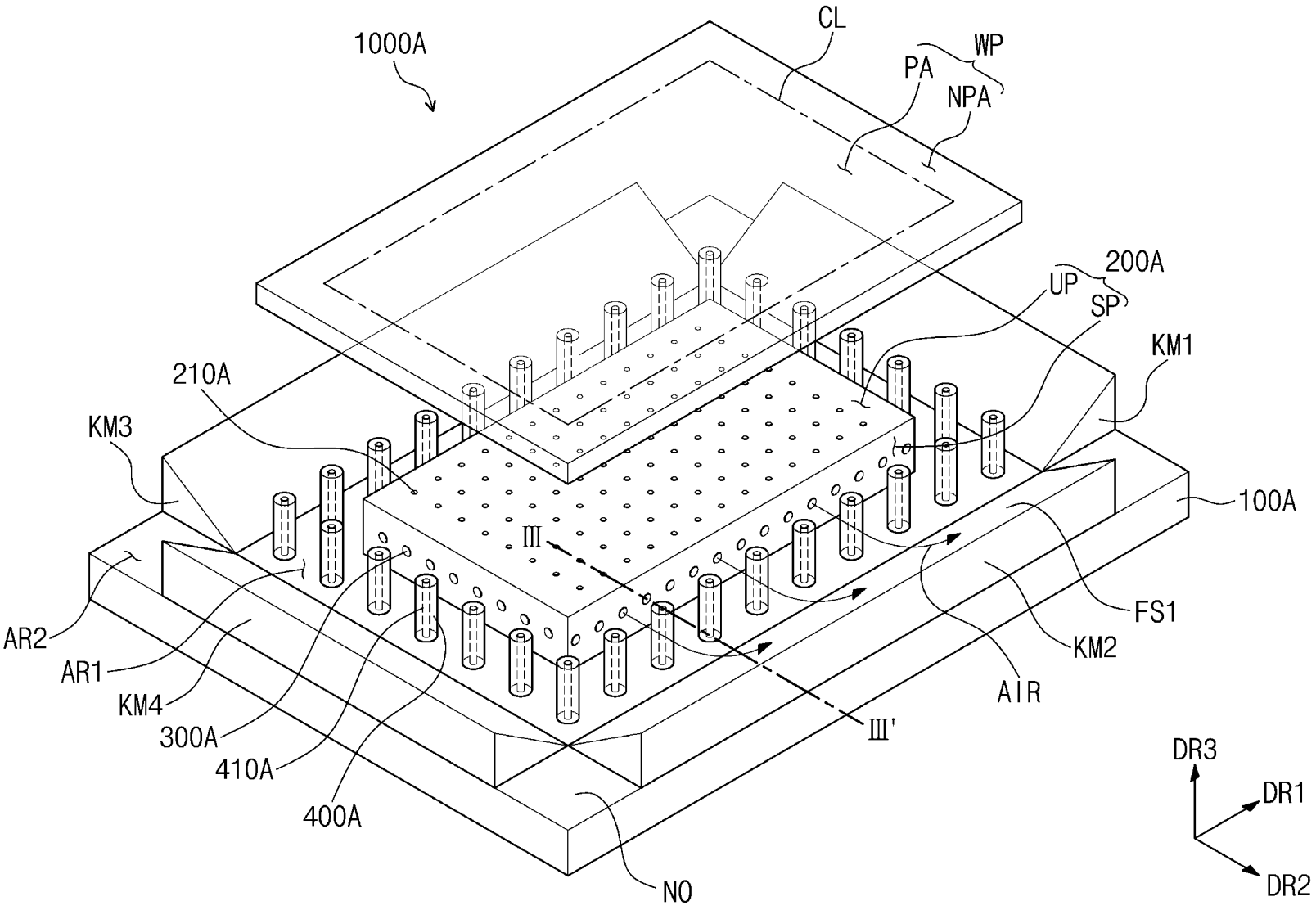
FIG. 6A is a perspective view illustrating a substrate cutting device according to an embodiment of the present disclosure.
Figure 6B:
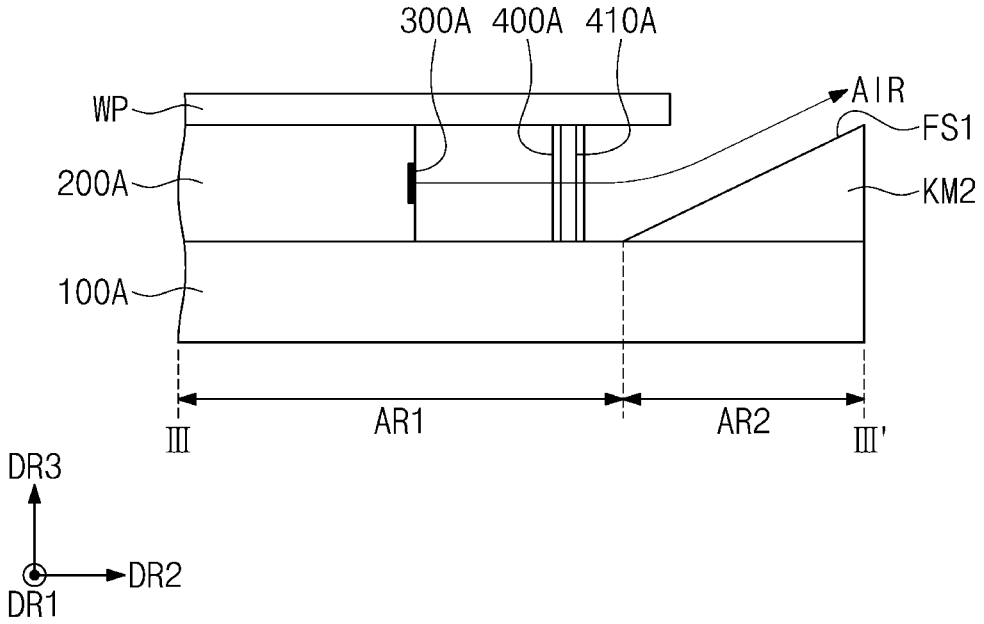
FIG. 6B is a sectional view taken along the line III-III' of FIG. 6A.

FIG. 6A is a perspective view illustrating a substrate cutting device according to an embodiment of the present disclosure, and FIG. 6B is a sectional view taken along the line III-III' of FIG. 6A. For concise description, elements previously described with reference to FIGS. 1A-20 may be identified by the same reference number, and overlapping description thereof may be omitted.

The base portion 100 may have the first region AR1 and the second region AR2. The first region AR1 may overlap the stage 200 and the partition member 400, and the second region AR2 may be defined to surround (e.g., to be around or surround the periphery of) the first region AR1.

Inclined patterns KM1, KM2, KM3, and KM4 may be provided on the second region AR2 to be spaced apart from the stage 200 with the partition member 400 interposed therebetween, and each of the inclined patterns KM1, KM2, KM3, and KM4 may have an inclined surface FS1 having a height that increases with increasing distance from the stage 200. When a gaseous substance AIR is exhausted through the exhausting structure 300 provided in the connection surface SP, the gaseous substance AIR may be exhausted to the outside via air pathways between the partition members 400 and along the inclined surfaces FS1 of the inclined patterns KM1, KM2, KM3, and KM4.

The inclined patterns KM1, KM2, KM3, and KM4 may be provided to expose at least a portion (e.g., a corner) NO of the second region AR2. In the illustrated embodiment, the inclined patterns KM1, KM2, KM3, and KM4 may be configured to allow the foreign substance to be exhausted to the outside via exhaust pathways passing through a region above the cell substrate WP. For example, a suction device is provided above the cell substrate WP to realize an upward flow of the foreign substance, as shown in FIG. 6B, and the upward flow of the gaseous substance AIR may more effectively exhaust the foreign substance to the outside.

Figure 7A:
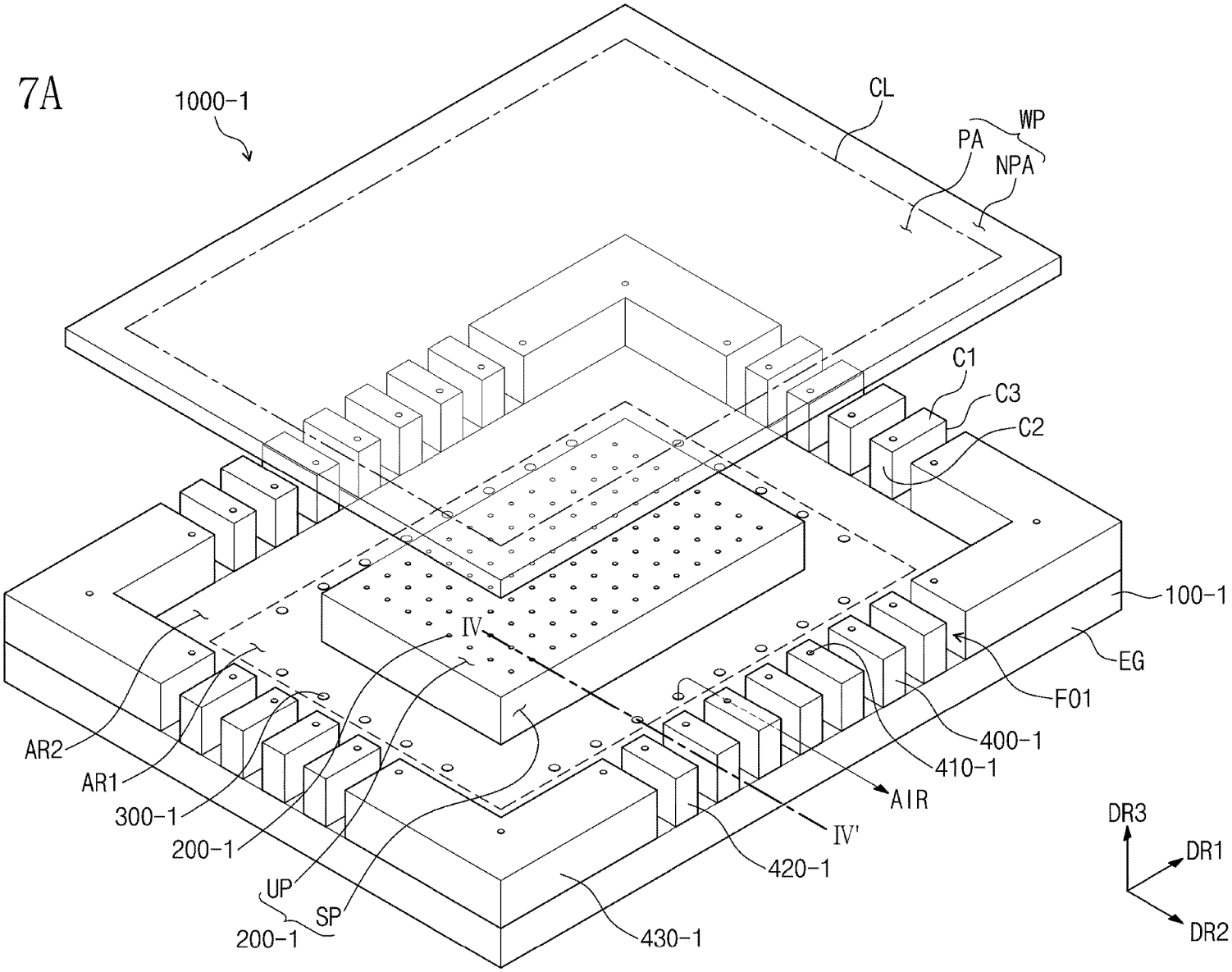
FIG. 7A is a perspective view illustrating a substrate cutting device according to an embodiment of the present disclosure.
Figure 7B:
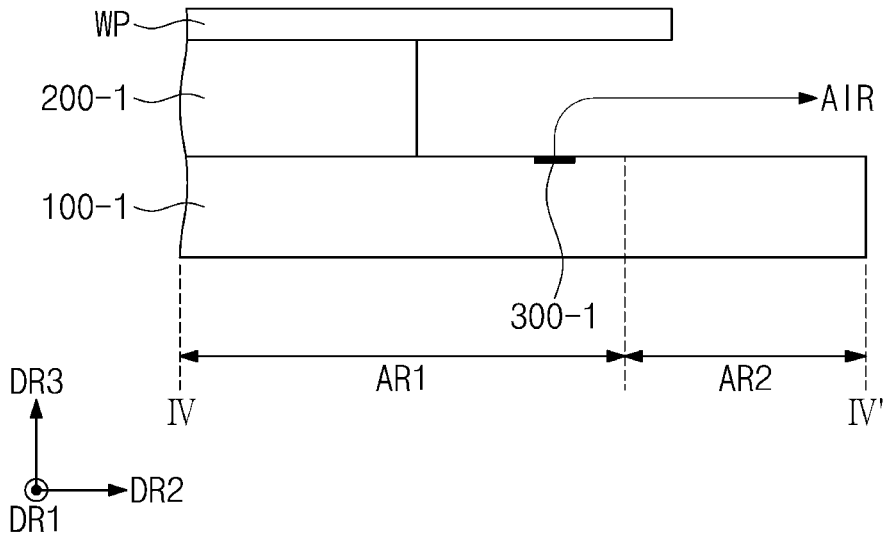
FIG. 7B is a sectional view taken along the line IV-IV' of FIG. 7A.

FIG. 7A is a perspective view illustrating a substrate cutting device according to an embodiment of the present disclosure, and FIG. 7B is a sectional view taken along the line IV-IV' of FIG. 7A. For concise description, elements previously described with reference to FIGS. 1A-2C may be identified by the same reference number, and overlapping description thereof may be omitted.

In this embodiment, a partition member 400-1 may have a top surface C1, an inner surface C2, and an outer surface C3. The top surface C1 may support the cell substrate WP. The top surface C1 may be substantially coplanar with the top surface UP of the stage 200.

The inner surface C2 may be connected to the top surface C1 to face the connection surface SP. The inner surface C2 may surround (e.g., may be around or may surround a periphery of) a stage 200-1. The outer surface C3 may be connected to the top surface C1 to face (e.g., to be opposite) the inner surface C2. The outer surface C3 may be aligned with an edge surface EG of a base portion 100-1.

A plurality of penetration openings (e.g., penetration holes) FO1 may be defined in the partition member 400-1. The penetration openings FO1 may be formed to penetrate the inner surface C2 and the outer surface C3. A gaseous substance AIR to be exhausted through an exhausting structure 300-1 may be exhausted to the outside through the penetration openings FO1. Accordingly, an airflow flowing from the exhausting structure 300-1 to the outside through the penetration openings FO1 may be formed.

In the illustrated embodiment, the penetration openings FO1 may be defined to penetrate the inner surface C2, the outer surface C3, and the top surface C1. Accordingly, the partition member 400-1 may include first sub-partition members 420-1, which are separated by the penetration openings FO1, and one or more second sub-partition members 430-1.

In some embodiments, a plurality of the first sub-partition members 420-1 may be arranged to be spaced apart from each other in the first direction DR1 and/or the second direction DR2. Gap regions between the first sub-partition members 420-1 may be defined by the penetration openings FO1. The first sub-partition members 420-1 (e.g., areas or regions between adjacent ones of the first sub-partition members 420-1) may substantially define passages through which airflows pass.

The second sub-partition member 430-1 may have a bent shape (e.g., an "L" shape). The second sub-partition member 430-1 may include a portion extending in the first direction DR1 and another portion extending in the second direction DR2. The second sub-partition member 430-1 may connect (or may extend between) the first sub-partition members 420-1 that are arranged in the first direction DR1 and the first sub-partition members 420-1 that are arranged in the second direction DR2 (e.g., the second sub-partition member 430-1 may be provided at a corner of the base portion 100-1).

Figure 8A:
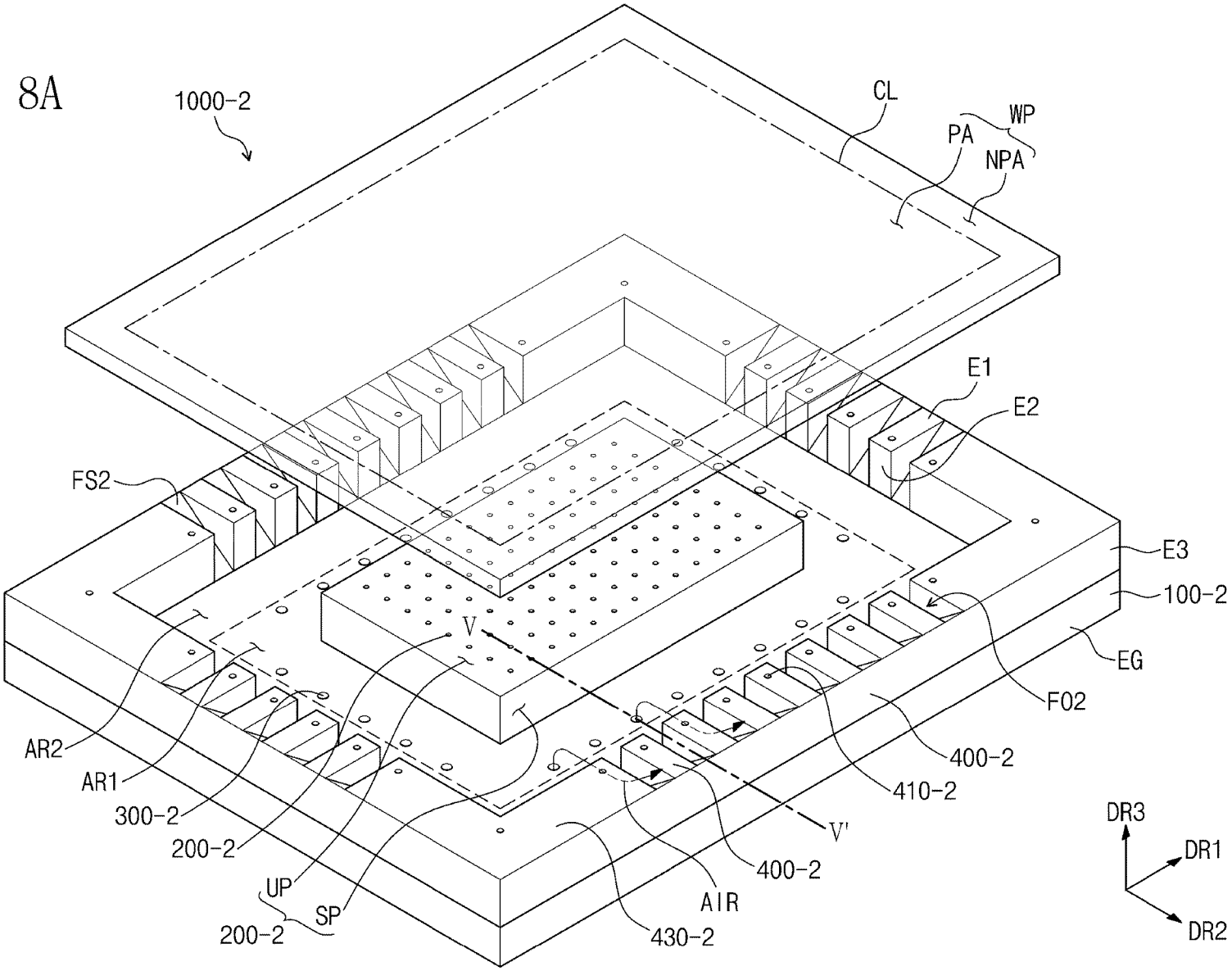
FIG. 8A is a perspective view illustrating a substrate cutting device according to an embodiment of the present disclosure.
Figure 8B:
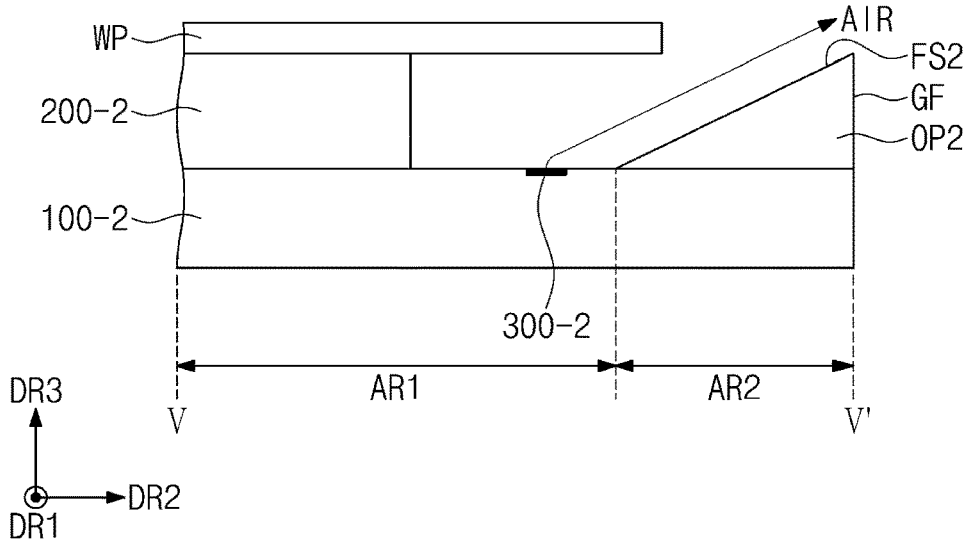
FIG. 8B is a sectional view taken along the line V-V' of FIG. 8A.

FIG. 8A is a perspective view illustrating a substrate cutting device according to an embodiment of the present disclosure, and FIG. 8B is a sectional view taken along the line V-V' of FIG. 8A. For concise description, elements previously described with reference to FIGS. 1A-2C, 7A, and 7B may be identified by the same reference number, and overlapping descriptions thereof may be omitted.

In this embodiment, a partition member 400-2 may have a top surface E1, an inner surface E2, and an outer surface E3. The top surface E1 may support the cell substrate WP. The top surface E1 may be substantially coplanar with the top surface UP of the stage 200.

The inner surface E2 may be connected to the top surface E1 to face the connection surface SP. The inner surface E2 may surround (e.g., may be around or may surround a periphery of) a stage 200-2. The outer surface E3 may be connected to the top surface E1 to face (e.g., to be opposite) the inner surface E2. The outer surface E3 may be aligned with the edge surface EG of a base portion 100-2.

A plurality of penetration openings (e.g., penetration holes) FO2 may be defined in the partition member 400-2. The penetration openings FO2 may be formed to penetrate the inner surface E2 and the top surface E1. A gaseous substance AIR to be exhausted through an exhausting structure 300-2 may be exhausted to the outside through the penetration openings FO2. Different from the penetration openings FO1 shown in FIG. 7A, each of the penetration openings FO2 according to this embodiment may have an inclined surface FS2. A height of the inclined surface FS2 may increase with increasing distance from the exhausting structure 300-2. As shown in FIG. 8B, the gaseous substance AIR, which is exhausted through the exhausting structure 300-2, may be exhausted to a region above a substrate cutting device 1000-2 via air pathways, which are defined between the partition members 400-2 and along the inclined surface FS2 of the penetration openings FO2.

In some embodiments, a suction device may be provided above the cell substrate WP to realize an upward flow of a foreign substance, and the upward flow of the gaseous substance AIR may more effectively exhaust the foreign substance to the outside. Thus, an amount of a foreign substance accumulated during the cutting process may be reduced and, thereby, a highly reliable display module may be realized.

Figure 9:
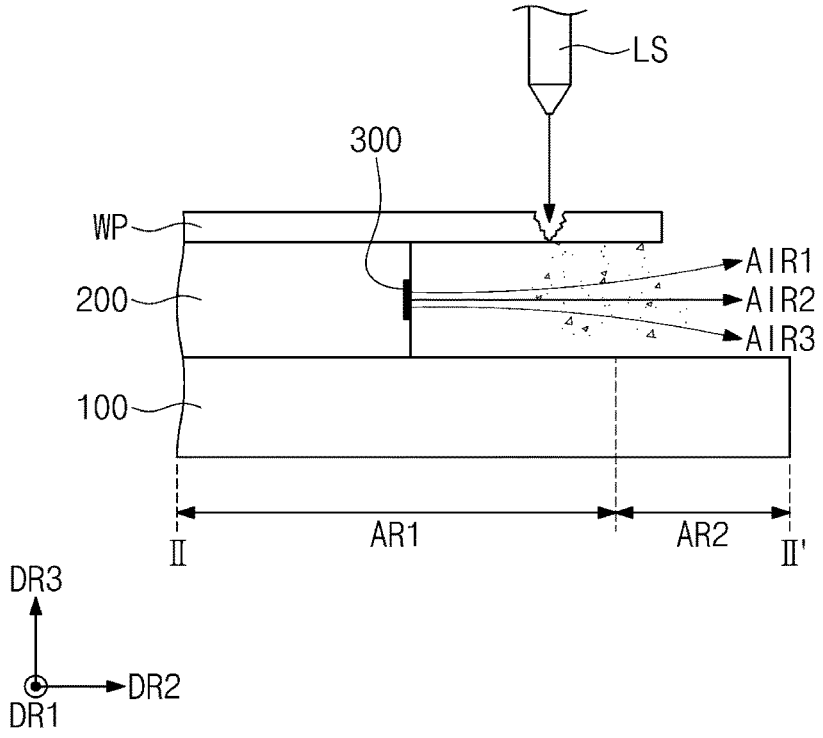
FIG. 9 is a sectional view illustrating a flow of a gaseous substance to be exhausted through an exhausting structure according to an embodiment of the present disclosure.

FIG. 9 is a sectional view illustrating a flow of a gaseous substance to be exhausted through an exhausting structure according to an embodiment of the present disclosure. For concise description, elements previously described with reference to FIGS. 1A-2C may be identified by the same reference number, and overlapping descriptions thereof may be omitted.

In this embodiment, the exhausting structure 300 provided in the connection surface SP may be configured to allow gaseous substances AIR1, AIR2, and AIR3 to be exhausted at various exhaust angles. Thus, various airflows may be formed in an internal space defined by the cell substrate WP, the connection surface SP of the stage 200, and the base portion 100. As a result, a foreign substance, which may be produced during a cutting process by using the cutting member LS, may be effectively exhausted to the outside while preventing or reducing deposition of the foreign substance on the base portion 100. However, the present disclosure is not limited thereto, and for example, even when the exhausting structure 300 is provided in the base portion 100 as shown in, for example, FIG. 3C, the exhausting structure 300 may be configured to realize various exhaust angles of the gaseous substances.

According to embodiments of the present disclosure, a foreign substance may be easily removed from an internal space of a substrate cutting device. Accordingly, a service life of the substrate cutting device and process efficiency of a substrate cutting process may be improved.

While embodiments of the present disclosure have been shown and described herein, it will be understood by one of ordinary skill in the art that variations in form and detail may be made therein without departing from the spirit and scope of the attached claims and their equivalents.

What is claimed is:

1. A substrate cutting platform comprising:

a base portion;

a stage on the base portion, the stage having a top surface configured to support a cell substrate and a connection surface perpendicular to the top surface;

a partition member spaced from the stage, the partition member facing the connection surface and configured to support the cell substrate, the stage and the partition member being within an outer periphery of the cell substrate; and an exhausting structure below the cell substrate and being configured to exhaust a gaseous substance.

2. A substrate cutting platform comprising a base portion;

a stage on the base portion, the stage having a top surface configured to support a cell substrate and a connection surface perpendicular to the top surface;

a partition member spaced from the stage, the partition member facing the connection surface and configured to support the cell substrate; and an exhausting structure below the cell substrate and being configured to exhaust a gaseous substance, wherein the exhausting structure is in the connection surface and is configured to produce an airflow flowing toward the partition member.

3. The substrate cutting platform of claim 1, wherein the exhausting structure is between the stage and the partition member and is configured to produce an airflow flowing toward the partition member.

4. The substrate cutting platform of claim 1, wherein the partition member comprises a plurality of partition members spaced from each other.

5. The substrate cutting platform of claim 4, wherein the exhausting structure is between adjacent ones of the partition members when viewed in a direction normal to the connection surface.

6. The substrate cutting platform of claim 4, wherein the exhausting structure partially overlaps two adjacent ones of the partition members when viewed in a direction normal to the connection surface.

7. The substrate cutting platform of claim 4, wherein the exhausting structure overlaps a plurality of the partition members when viewed in a direction normal to the connection surface.

8. The substrate cutting platform of claim 1, wherein the partition member has a first surface configured to support the cell substrate, a second surface on the base portion and being opposite the first surface, and a side surface extending between the first surface and the second surface.

9. The substrate cutting platform of claim 8, wherein each of the first and second surfaces has a polygonal shape defined by at least three vertices and edges joining the vertices.

10. The substrate cutting platform of claim 9, wherein a first vertex of the first surface from among the at least three vertices of the first surface overlaps a second vertex of the second surface from among the at least three vertices of the second surface when viewed in a plan view, and wherein the first and second vertices face the connection surface.

11. The substrate cutting platform of claim 8, wherein at least a portion of the side surface facing the connection surface has a curved shape.

12. The substrate cutting platform of claim 8, wherein the top surface of the stage is substantially coplanar with the first surface of the partition member.

13. The substrate cutting platform of claim 1, wherein the partition member has:

a top surface configured to support an outer portion of the cell substrate;

an inner surface connected to the top surface, facing the connection surface, and surrounding a periphery of the stage;

an outer surface connected to the top surface and being opposite the inner surface; and a penetration opening penetrating the inner surface and the outer surface and configured for the gaseous substance to be exhausted to an outside of the partition member therethrough.

14. The substrate cutting platform of claim 1, further comprising an inclined pattern, the inclined pattern being spaced from the stage with the partition member therebetween and having an inclined surface with a height that increases with increasing distance from the stage, wherein the gaseous substance is to be exhausted to an outside along the inclined surface.

15. The substrate cutting platform of claim 1, wherein at least one of the partition member and the stage has a suction opening through which a gaseous substance is to be inhaled, and wherein the cell substrate is secured to the at least one of the partition member and the stage in a vacuum suction manner by the suction opening.

16. The substrate cutting platform of claim 1, further comprising a cutting member configured to cut the cell substrate along a cutting line, wherein the cutting line is between the stage and the partition member.

17. The substrate cutting platform of claim 16, wherein the exhausting structure comprises a plurality of exhausting structures overlapping the cutting line when viewed in a plan view.

18. A substrate cutting device comprising:

a base portion having a first region and a second region surrounding a periphery of the first region;

a stage on the first region, the stage having a top surface configured to support a cell substrate and a connection surface perpendicular to the top surface;

a cutting member configured to cut the cell substrate along a cutting line;

a partition member on the second region and spaced from the stage, the partition member facing the connection surface and being configured to support the cell substrate; and an exhausting structure in the first region and configured to exhaust a gaseous substance toward a region below the cell substrate and to produce an airflow flowing from the first region toward the second region.

19. The substrate cutting device of claim 18, further comprising an inclined pattern spaced from the stage with the partition member therebetween and having an inclined surface with a height that increases with increasing distance from the stage, wherein the airflow is produced to exhaust the gaseous substance in an outward direction along the inclined surface.

20. The substrate cutting device of claim 18, wherein the exhausting structure comprises a plurality of exhausting structures overlapping the cutting line when viewed in a plan view.

* * * * *